US010095171B2

(12) United States Patent
Shirafuji et al.

(10) Patent No.: US 10,095,171 B2
(45) Date of Patent: Oct. 9, 2018

(54) IMAGE FORMING APPARATUS

(71) Applicant: CANON KABUSHIKI KAISHA, Tokyo (JP)

(72) Inventors: Yasuhito Shirafuji, Kashiwa (JP); Naoka Omura, Matsudo (JP); Ryuichi Araki, Funabashi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/642,693

(22) Filed: Jul. 6, 2017

(65) Prior Publication Data

US 2018/0017919 A1 Jan. 18, 2018

(30) Foreign Application Priority Data

Jul. 13, 2016 (JP) ..... 2016-138233

(51) Int. Cl.
*G03G 15/01* (2006.01)
*G03G 15/00* (2006.01)

(52) U.S. Cl.
CPC ..... *G03G 15/5054* (2013.01); *G03G 15/0189* (2013.01); *G03G 2215/0158* (2013.01)

(58) Field of Classification Search
CPC ..... G03G 15/5054; G03G 15/0189; G03G 2215/0158
USPC ..... 399/39
See application file for complete search history.

(56) References Cited

U.S. PATENT DOCUMENTS

| | | | |
|---|---|---|---|
| 6,930,786 | B2 | 8/2005 | Kataoka et al. |
| 8,908,225 | B2 | 12/2014 | Zaima et al. |
| 9,360,786 | B2 | 6/2016 | Ohta et al. |
| 9,459,579 | B2 | 10/2016 | Shirafuji |
| 2017/0235266 | A1 | 8/2017 | Ino et al. |

FOREIGN PATENT DOCUMENTS

| | | | | |
|---|---|---|---|---|
| JP | 2013201489 A | * | 10/2013 | ..... G06T 1/0028 |
| WO | WO 03096887 A1 | * | 11/2003 | ..... H04N 9/093 |

* cited by examiner

*Primary Examiner* — Susan Lee
(74) *Attorney, Agent, or Firm* — Fitzpatrick, Cella, Harper & Scinto

(57) ABSTRACT

Provided is an image forming apparatus, which is capable of detecting a color misregistration amount with high accuracy even when a density characteristic thereof is changed. The image forming apparatus includes a plurality of image forming units configured to form toner images of different colors on a predetermined intermediate transfer belt, and a density sensor configured to measure densities of the toner images formed on the intermediate transfer belt. The image forming apparatus determines a density target depending on a measurement result of a density correction image, which is formed by the plurality of image forming units, from the density sensor. The image forming apparatus causes the plurality of image forming units to form position detection images so that the position detection images have densities corresponding to the density target.

14 Claims, 16 Drawing Sheets

IMAGE FORMING APPARATUS

BACKGROUND OF THE INVENTION

Field of the Invention

The present invention relates to an image forming apparatus configured to form a color image, for example, a copying machine, a printer, or a facsimile machine.

Description of the Related Art

An image forming apparatus includes, for example, a plurality of photosensitive members, which are provided for respective colors, and an intermediate transfer member. Such image forming apparatus forms toner images of different colors on the plurality of photosensitive members, and transfers (primarily transfers) the toner images of the respective colors from the photosensitive members onto the intermediate transfer member in a superposed manner. The intermediate transfer member transfers (secondarily transfers) the transferred toner images onto a sheet. In this manner, the image forming apparatus forms an image on the sheet. The image forming apparatus is configured for preventing misregistration of transfer positions of the toner images of the respective colors during the primary transfer and the secondary transfer. However, due to a part tolerance, an assembly tolerance, and a positional variation of a part caused by an increased temperature in the apparatus during image formation, misregistration of the transfer positions of the toner images on the intermediate transfer member and on the sheet may occur. This phenomenon is called "color misregistration". In order to maintain the quality of the image to be formed, the image forming apparatus performs processing of detecting and correcting the color misregistration in the apparatus (color misregistration correction processing).

During the color misregistration correction processing, the image forming apparatus forms a position detection image for detecting a position of the toner image for each color on any one of the respective photosensitive members, the intermediate transfer member, a conveying belt for conveying the sheet, and the sheet, for example. The image forming apparatus detects the position at which the position detection image is formed to calculate a shift in interval among colors (color misregistration amount), and corrects the positions at which the images of the respective colors are formed in accordance with the calculated shift to perform the color misregistration correction processing.

The position at which the position detection image is formed is detected by a reflective photosensor, for example. The reflective photosensor includes a light emitting portion and a light receiving portion. For example, when a position detection image formed on the intermediate transfer member is detected, the light emitting portion irradiates the intermediate transfer member. The intermediate transfer member reflects light radiated from the light emitting portion. The light receiving portion receives reflection light (for example, diffuse reflection light) from the intermediate transfer member. A position at which the position detection image is formed and a position at which the position detection image is not formed on the intermediate transfer member are different in reflectance of light. Therefore, the light receiving portion receives a different amount of reflection light depending on the presence or absence of the position detection image. The light receiving portion outputs an analog signal, which is an analog electrical signal having a value corresponding to the received amount of reflection light.

A description is given of a waveform of the analog signal in a case where the reflectance at the position at which the position detection image is not formed on the intermediate transfer member is lower than the reflectance at the position at which the position detection image is formed. In general, the intermediate transfer member rotates in order to convey the toner images from a position at which the primary transfer is performed to a position at which the secondary transfer is performed. The reflective photosensor detects the position detection image (toner image) from the rotating intermediate transfer member. The position detection image enters a detection area of the reflective photosensor in accordance with the rotation of the intermediate transfer member, and then leaves the detection area. Therefore, the amount of reflection light received by the light receiving portion is gradually increased, and then gradually decreased. As a result, the analog signal output from the light receiving portion has a protruding waveform. A value of the analog signal at a time when the position detection image occupies the detection area of the reflective photosensor at a 100% filling ratio is a peak value (maximum value).

The analog signal has a triangle waveform when the reflectance of the surface of the intermediate transfer member on which the toner image is formed is uniform, the reflective photosensor has no part tolerance, and the position detection image has an ideal shape. However, in reality, due to a change in shape of the surface of the intermediate transfer member on which the toner image is formed, the part tolerance of the reflective photosensor, unevenness of the position detection image, and other such reasons, the analog signal has a distorted triangle waveform.

When the color misregistration amount is calculated based on the measurement result of the position detection image, the reflective photosensor detects position detection images of the respective colors (yellow, magenta, and cyan) consecutively in accordance with the rotation of the intermediate transfer member. The analog signals indicating positions of the images of the respective colors, which are output from the light receiving portion of the reflective photosensor, are binarized (binarized signals) with a predetermined threshold by a comparator. A barycentric position between a low-to-high transition edge and a high-to-low transition edge of the binarized signal is a position at which the position detection image is formed. The color misregistration amount is calculated based on distances among barycentric positions of the respective colors.

When the analog signal is distorted, the barycentric position between the edges of the binarized signal has an error (shift) from a barycentric position at a time when the analog signal is not distorted. The color misregistration amount is calculated based on the distances among the barycentric positions of the respective colors, and hence, when errors of the barycentric positions of the respective colors are the same, the errors are canceled out during the calculation of the color misregistration amount to calculate an accurate color misregistration amount. Most factors responsible for the distortion of the analog signal equally affect waveforms of the analog signals of the respective colors, and hence the errors of the barycentric positions of the respective colors are generally equivalent. To that end, there is known an image forming apparatus, which sets in advance image data for forming a position detection image for each color so that peak values of analog signals match (U.S. Pat. No. 6,930,786). This image forming apparatus can reduce an error of a color misregistration amount because detection errors of barycentric positions of analog signals for respective colors, which are generated by detecting the position detection images of the respective colors, are equal to one another.

However, even when the position detection images are formed based on the image data set in advance so that the peak values match, actually measured peak values of the position detection images of the respective colors may be different. This is because a density characteristic of the image forming apparatus is changed due to a change in environmental conditions, such as a temperature and a humidity, and deterioration of a developer.

For example, in the image forming apparatus described in U.S. Pat. No. 6,930,786, image data is set so that a peak value of a waveform of an analog signal obtained based on a black position detection image and peak values of waveforms of analog signals obtained based on position detection images of the other colors are equal to each other. There may be a case where, when a density characteristic of the image forming apparatus is changed, a relationship between the peak value of the waveform of the analog signal obtained based on the black position detection image, which is formed based on the image data that has been set in advance, and the peak values of the waveforms of the analog signals obtained based on the position detection images of the other colors is changed. In this case, the peak values of the waveforms of the analog signals obtained based on the position detection images of the respective colors are different, and thus it becomes difficult to detect the color misregistration amount with high accuracy.

SUMMARY OF THE INVENTION

An image forming apparatus configured to form an image on a sheet according to the present disclosure includes: a plurality of image forming units configured to form images of different colors based on image data; an intermediate transfer member; a measurement unit configured to measure a measurement image that is transferred onto the intermediate transfer member; a selecting unit configured to control the plurality of image forming units to form first measurement images of different colors, control the measurement unit to measure the first measurement images on the intermediate transfer member, and select a color of interest based on measurement results of the first measurement images; a determination unit configured to determine measurement image data based on a measurement result of a first measurement image of the color of interest selected by the selecting unit, and on a measurement result of a first measurement image of another color; and a controller configured to control the plurality of image forming units to form second measurement images of different colors based on the measurement image data, control the measurement unit to detect a color misregistration amount for relative positions of a second measurement image of a reference color of the second measurement images and a second measurement image of another color of the second measurement images, and correct a write timing of each of the plurality of image forming units based on the color misregistration amount.

Further features of the present invention will become apparent from the following description of exemplary embodiments (with reference to the attached drawings).

DESCRIPTION OF THE EMBODIMENTS

Now, an embodiment of the present invention is described in detail with reference to the drawings.

Overall Configuration

Figure 1:
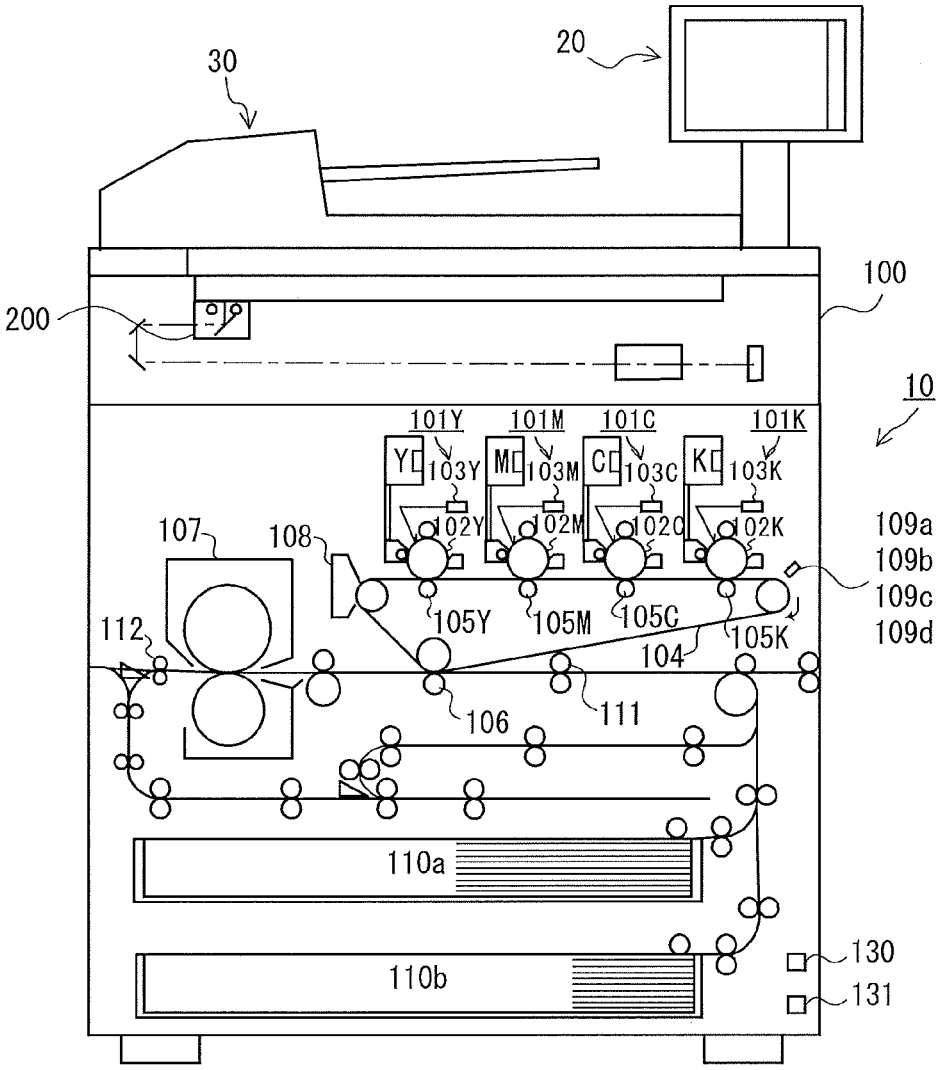
FIG. 1 is a configuration diagram of an image forming apparatus.

FIG. 1 is a configuration diagram of an image forming apparatus according to this embodiment. An image forming apparatus 10 is connected to an operation device 20 and an image reading apparatus 30. The operation device 20 is a user interface including various input keys, numeric keys, and other such input devices, and a display and other such output devices. The display may be a touch panel display. A user may input various settings, job instructions, and the like to the image forming apparatus 10 via the operation device 20. On the display, a screen and the like are displayed when the settings or instructions are input. The image reading apparatus 30 includes a scanner unit 100 including a reader portion 200. The image reading apparatus 30 is configured to read an image of an original with the reader portion 200, and generate image data expressing a result of the reading. The image forming apparatus 10 includes a communication mechanism configured to communicate with an external apparatus. The communication mechanism may communicate via a local area network (LAN) and other such networks, and a public communication network. The image forming apparatus 10 performs image forming processing in accordance with the image data generated by the image reading apparatus 30, and image data acquired from the external apparatus via the communication mechanism.

Image Forming Apparatus

In order to form images of the colors of yellow (Y), magenta (M), cyan (C), and black (K), the image forming apparatus 10 includes image forming units 101Y, 101M, 101C, and 101K corresponding to the respective colors. The letters Y, M, C, and K at the end of the reference symbols represent yellow, magenta, cyan, and black, respectively. In the following, when there is no need to distinguish the colors, the description is given without adding the letters Y, M, C, and K to the end of the reference symbols. The same also applies to other components provided for each of the colors. The image forming units 101Y, 101M, and 101C function as a plurality of image forming units configured to form images of different colors. The image forming apparatus 10 additionally includes an intermediate transfer belt 104, a fixing device 107, and a conveying mechanism configured to convey a sheet.

The image forming units 101 include photosensitive drums 102, which are image bearing members, and exposure devices 103. The photosensitive drums 102Y, 102M, 102C, and 102K are arranged at predetermined intervals along the intermediate transfer belt 104. The photosensitive drum 102 is irradiated with laser light by the exposure device 103 after a surface thereof is uniformly charged, with the result that an electrostatic latent image corresponding to the image data is formed thereon. The electrostatic latent image is developed by a developing device. As a result, toner images corresponding to the image data are formed on the photosensitive drums 102. A yellow toner image is formed on the photosensitive drum 102Y. A magenta toner image is formed on the photosensitive drum 102M. A cyan toner image is formed on the photosensitive drum 102C. A black toner image is formed on the photosensitive drum 102K. The exposure device 103 is controlled to drive the emitted laser light with a laser drive signal based on the image data that has been corrected in gradation with a gradation correction table. The image data is prepared for each color, and the exposure device 103 is controlled to be driven in accordance with the laser drive signal based on the image data of the corresponding color.

Primary transfer portions 105Y to 105K are provided to correspond to the respective image forming units 101Y to 101K at positions across the intermediate transfer belt 104. The toner images formed on the respective photosensitive drums 102Y, 102M, 102C, and 102K are primarily transferred onto the intermediate transfer belt 104 so as to be sequentially superposed by the corresponding primary transfer portions 105Y, 105M, 105C, and 105K. As a result, a full-color image (toner image) is formed on the intermediate transfer belt 104. The intermediate transfer belt 104 is stretched around a drive roller, and is driven to rotate. The intermediate transfer belt 104 functions as an intermediate transfer member onto which an image is transferred. The intermediate transfer belt 104 also has a function of an image bearing member configured to bear the image. The intermediate transfer belt 104 is a side on which the toner image is primarily transferred, and is driven to rotate in a direction of from the image forming unit 101Y to the image forming unit 101K. With the rotation of the intermediate transfer belt 104, the toner image is conveyed to a secondary transfer portion 106.

Sheets are accommodated in sheet feeding trays 110*a* and 110*b*. The sheets are fed one by one from the sheet feeding trays 110*a* and 110*b*, and conveyed to registration rollers 111. The registration rollers 111 correct a skew and the like of the sheet, and convey the sheet to the secondary transfer portion 106 in accordance with a timing when the toner image is conveyed to the secondary transfer portion 106 by the intermediate transfer belt 104. The secondary transfer portion 106 secondarily transfers the toner image that has been formed on the intermediate transfer belt 104 onto the sheet that has been conveyed. Toner remaining on the intermediate transfer belt 104 after the secondary transfer is removed by a belt cleaner 108.

The sheet having the toner image transferred thereon is conveyed to the fixing device 107. The fixing device 107 heats and pressurizes the toner image that has been transferred onto the sheet to be fixed onto the sheet. This completes image formation onto the sheet. The sheet having the image formed thereon is discharged to the outside of the image forming apparatus 10 by sheet discharge rollers 112.

The image forming apparatus 10 includes a plurality of density sensors 109*a*, 109*b*, 109*c*, and 109*d*, each of which is configured to measure a density of the toner image formed on the intermediate transfer belt 104. Each of the density sensors 109*a*, 109*b*, 109*c*, and 109*d* functions as a measurement unit configured to measure a measurement image. The density sensors 109*a*, 109*b*, 109*c*, and 109*d* are provided on a downstream side of the image forming unit 101K in a direction of movement (direction of rotation) of the intermediate transfer belt 104. The density sensors 109*a*, 109*b*, 109*c*, and 109*d* are arranged so that their detection areas do not overlap in a direction orthogonal to the direction of movement (direction of rotation) of the intermediate transfer belt 104. The density sensor 109*d* is used during image density correction, which is to be described later. The density sensors 109*a*, 109*b*, and 109*c* are used during color misregistration correction, which is to be described later. The image forming apparatus 10 includes a temperature sensor 130, which is configured to detect a temperature in the apparatus, and a humidity sensor 131, which is configured to detect a humidity in the apparatus.

Density Sensor

Figure 2A:
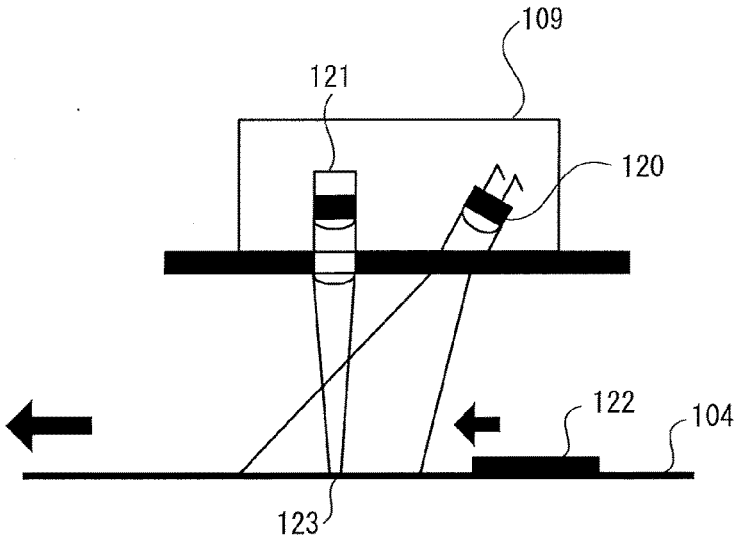
FIG. 2A, FIG. 2B, and FIG. 2C are explanatory diagrams of a density sensor.
Figure 2B:
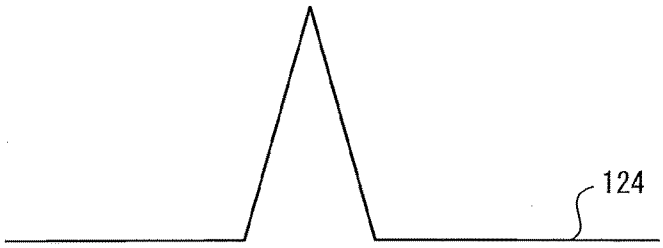
Figure 2C:
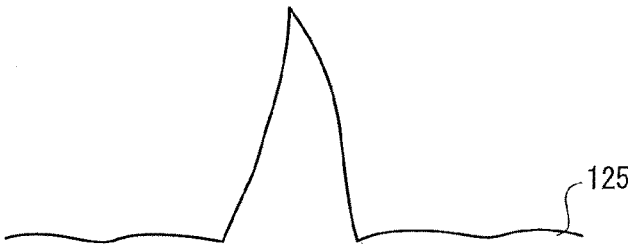

The density sensors 109*a*, 109*b*, and 109*c* are photosensors having the same structure. FIG. 2A to FIG. 2C are explanatory diagrams of the density sensors 109*a*, 109*b*, and 109*c*. When not distinguished, the density sensors are hereinafter described as "density sensor 109".

FIG. 2A is a configuration diagram of the density sensor 109. The density sensor 109 includes a light emitting portion 120 and a light receiving portion 121. The light emitting portion 120 is configured to irradiate the intermediate transfer belt 104. The intermediate transfer belt 104 reflects light radiated from the light emitting portion 120. The light receiving portion 121 is configured to receive reflection light (for example, diffuse reflection light) from the intermediate transfer belt 104. The light receiving portion 121 is arranged at a position at which an angle of incidence and an angle of reflection of the light from the light emitting portion 120 are not equal to each other so that the diffuse reflection light of the light radiated from the light emitting portion 120 to the intermediate transfer belt 104 may be received. A position at which a toner image 122 is formed and a position at which the toner image 122 is not formed on the intermediate transfer belt 104 are different in reflectance of the light. Therefore, the light receiving portion 121 receives a different amount of reflection light depending on the presence or absence of the toner image 122. The light receiving portion 121 outputs an analog signal (output value), which is an analog electrical signal indicating a value corresponding to the received amount of reflection light.

The density sensor 109 is configured to detect the toner image 122 from the rotating intermediate transfer belt 104. The toner image 122 enters a detection area 123 of the density sensor 109 in accordance with the rotation of the intermediate transfer belt 104, and then leaves the detection area 123. Therefore, the amount of reflection light received by the light receiving portion 121 is gradually increased, and then gradually decreased. As a result, the analog signal output from the light receiving portion 121 has a triangle waveform. FIG. 2B is an exemplary diagram of the waveform of such analog signal 124. A value of the analog signal at a time when the toner image 122 occupies the detection area 123 of the density sensor 109 at a 100% filling ratio is a peak value (maximum value).

In FIG. 2B, there is illustrated a waveform of the analog signal 124 in a case where the reflectance of the surface of the intermediate transfer belt 104 on which the toner image 122 is formed is uniform, the density sensor 109 has no part tolerance, and the toner image 122 has an ideal shape. However, in reality, due to a change in shape of the surface of the intermediate transfer belt 104 on which the toner image 122 is formed, the part tolerance of the density sensor 109, unevenness of the toner image 122, and other such reasons, the analog signal has a distorted triangle waveform. FIG. 2C is an exemplary diagram of the waveform of such analog signal 125.

Image Reading Apparatus

Figure 3:
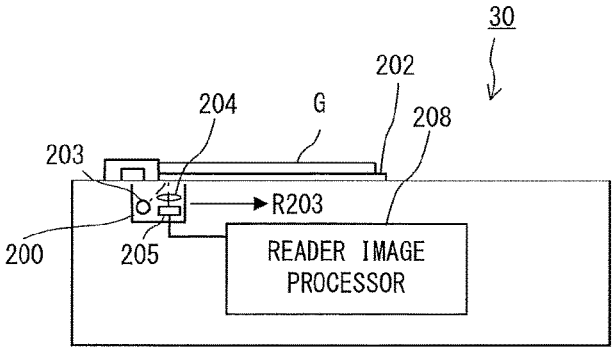
FIG. 3 is a configuration diagram of an image reading apparatus.

FIG. 3 is a configuration diagram of the image reading apparatus 30. The image reading apparatus 30 includes an original table 202, on which an original G is placed, a light source 203, an optical system 204, a charge-coupled device (CCD) image sensor 205, and a reader image processor 208. The light source 203, the optical system 204, and the CCD image sensor 205 form the reader portion 200. The light source 203 irradiates the original G placed on the original table 202 with light. The original G reflects the radiated light. The reflection light from the original G forms an image on a light receiving surface of the CCD image sensor 205 through the optical system 204. The CCD image sensor 205 sends a read signal, which is an analog signal corresponding to the amount of reflection light, to the reader image processor 208. The read signal indicates an image of the original G.

The reader portion 200 is moved in a direction of an arrow R203 in FIG. 3. As a result, the CCD image sensor 205 sends the read signal on the image of the entire surface of the original G to the reader image processor 208. The reader image processor 208 performs image processing on the read signal acquired from the CCD image sensor 205 to generate image data, which is a digital signal indicating the image of the entire surface of the original G. The reader image processor 208 sends the generated image data to the image forming apparatus 10. The reader image processor 208 also acquires a density value of the image formed on the original G from the read signal. In other words, the image reading apparatus 30 also functions as a density measuring device configured to measure a density of the image formed on the original G.

Control System

Figure 4:
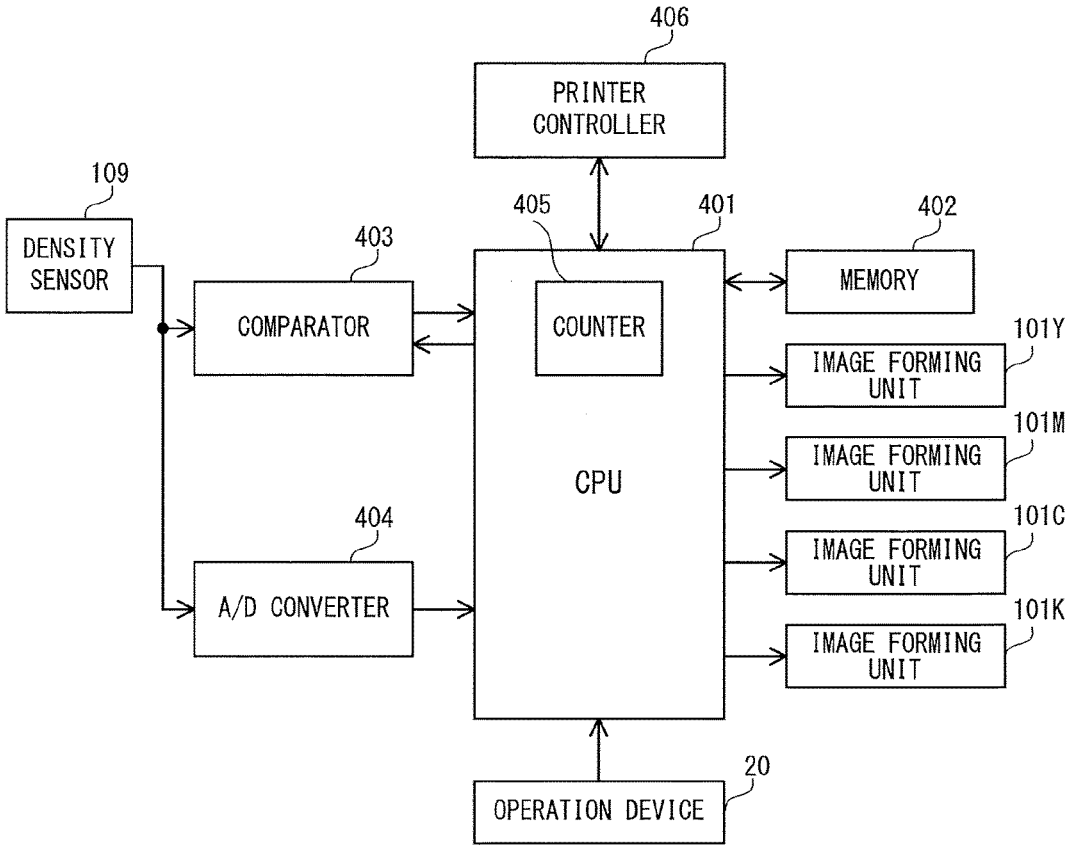
FIG. 4 is an explanatory diagram of a control system of the image forming apparatus.

FIG. 4 is an explanatory diagram of a control system of the image forming apparatus 10. This control system represents a configuration for executing the color misregistration correction and the image density correction in the image forming apparatus 10, and components for controlling other operation during the image forming processing are omitted. The control system is included in the image forming apparatus 10.

The control system includes a central processor (CPU) 401, a memory 402, a comparator 403, an A/D converter 404, and a printer controller 406. The CPU 401 includes a counter 405. The CPU 401 is connected to the memory 402, the comparator 403, the A/D converter 404, the printer controller 406, the image forming units 101Y, 101M, 101C, and 101K, and the operation device 20. The comparator 403 and the A/D converter 404 acquire, from the density sensors 109, analog signals of measurement results of the density of the toner image.

The CPU 401 reads and executes a computer program stored in the memory 402 to control operation of the image forming apparatus 10. The CPU 401 controls the operation of the image forming apparatus 10 in response to the various settings and instructions input via the operation device 20. In this embodiment, the CPU 401 performs the color misregistration correction and the image density correction. The memory 402 stores measurement image data, which is measurement images of respective colors.

The comparator 403 is configured to binarize the analog signals, which are acquired from the density sensor 109, by comparing the analog signals with a predetermined threshold to generate binarized signals. Details of the processing of the comparator 403 are described later. The comparator 403 sends the generated binarized signals to the CPU 401. The A/D converter 404 quantizes the analog signals, which are acquired from the density sensor 109, to generate digital signals (density digital signals). The A/D converter 404 sends the generated density digital signals to the CPU 401.

The CPU 401 counts, with the counter 405, a period in which the comparator 403 outputs a high-level digital signal. A count value is stored in the memory 402. Then, the CPU 401 acquires a time interval between an intermediate time point of the high-level digital signal and an intermediate time point of another high-level digital signal. The CPU 401 detects a positional relationship among the toner images of the respective colors based on the time interval between the intermediate time point of the high-level digital signal and the intermediate time point of the another high-level digital signal. The CPU 401 detects a positional shift amount (color misregistration amount) among the toner images of the respective colors based on the detected positional relationship. Moreover, the CPU 401 detects densities of the toner images in accordance with the density digital signals acquired from the A/D converter 404. The CPU 401 performs the color misregistration correction based on the detected color misregistration amount, and performs the image density correction based on the detected toner densities. The CPU 401 sends, to each of the image forming units 101Y, 101M, 101C, and 101K, control signals for the color misregistration correction and the image density correction.

Color Misregistration Correction

Color misregistration, which is a shift in relative positions generated among the toner images of the respective colors, which are transferred from the respective image forming units 101Y, 101M, 101C, and 101K onto the intermediate transfer belt 104, is described. As described above, the toner images of the corresponding colors are formed on the respective photosensitive drums 102Y, 102M, 102C, and 102K. The toner images formed on the respective photosensitive drums 102Y, 102M, 102C, and 102K are transferred onto the intermediate transfer belt 104 to form a color image on the intermediate transfer belt 104. The shift in transfer positions from the respective photosensitive drums 102Y, 102M, 102C, and 102K to the intermediate transfer belt 104 at this time is the color misregistration. When the color misregistration occurs, a difference in tint occurs between an image that is originally intended to be formed and an image that is actually formed. This causes a reduction in image quality of an image that is eventually formed on the sheet.

When being powered on, in a case where returning from a standby state, and when having formed images on a predetermined number (cumulative number) of sheets, the image forming apparatus 10 forms, at predetermined timings, position detection images of the respective colors, which are the toner images for the color misregistration correction, on the intermediate transfer belt 104. The image forming apparatus 10 corrects the shift in relative positions of the toner images of the respective colors (color misregistration correction) based on measurement results of those position detection images.

Figure 5:
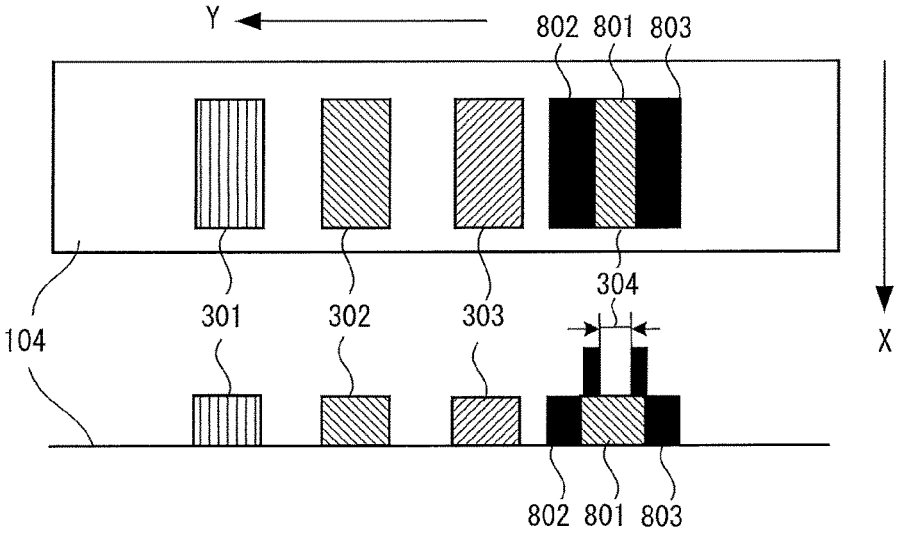
FIG. 5 is an exemplary diagram of position detection images.

FIG. 5 is an exemplary diagram of the position detection images formed on the intermediate transfer belt 104. Those position detection images include a yellow position detection image 301, a magenta position detection image 302, a cyan position detection image 303, and a composite toner pattern 304, which is a black position detection image. The yellow position detection image 301 is a toner image for detecting a position at which the yellow toner image is formed. The magenta position detection image 302 is a toner image for detecting a position at which the magenta toner image is formed. The cyan position detection image 303 is a toner image for detecting a position at which the cyan toner image is formed. The composite toner pattern 304 is a toner image for detecting a position at which the black toner image is formed.

The composite toner pattern 304 is formed of a combination of a chromatic-color toner pattern and black toner patterns. In this embodiment, black toner patterns 802 and 803 are formed to be partially superposed on a magenta toner pattern 801. In the composite toner pattern 304, the black toner patterns 802 and 803 are formed at a predetermined interval in the direction of rotation of the intermediate transfer belt 104 so that the magenta toner pattern 801 is exposed from therebetween. The composite toner pattern 304 is formed by first transferring the magenta toner pattern 801 from the photosensitive drum 102M, and then transferring the black toner patterns 802 and 803 from the photosensitive drum 102K so as to sandwich the toner pattern 801.

The position detection images 301, 302, and 303 of the respective colors and the composite toner pattern 304 are formed side by side in the direction of rotation (Y direction) of the intermediate transfer belt 104. Although not shown in FIG. 5, another combination of the position detection images 301, 302, and 303 of the respective colors and the composite toner pattern 304 having the same structure is formed separately in a direction (X direction) orthogonal to the direction of rotation of the intermediate transfer belt 104. The X direction is a direction of a rotary shaft of the photosensitive drum 102, and a main scanning direction of scanning with the laser light by the exposure device 103. The Y direction is a sub-scanning direction orthogonal to the main scanning direction.

The image forming apparatus 10 according to this embodiment sets magenta as a reference color, and detects relative positions of the position detection images 301 and 303 of other colors and the composite toner pattern 304 with respect to a position of the magenta position detection image 302. Based on the detected relative positions, the image forming apparatus 10 calculates a color misregistration amount for each color. The image forming apparatus 10 performs the color misregistration correction depending on the calculated color misregistration amount so that the shift is not generated among the toner images of the respective colors transferred onto the intermediate transfer belt 104 during the image formation.

Figure 6:
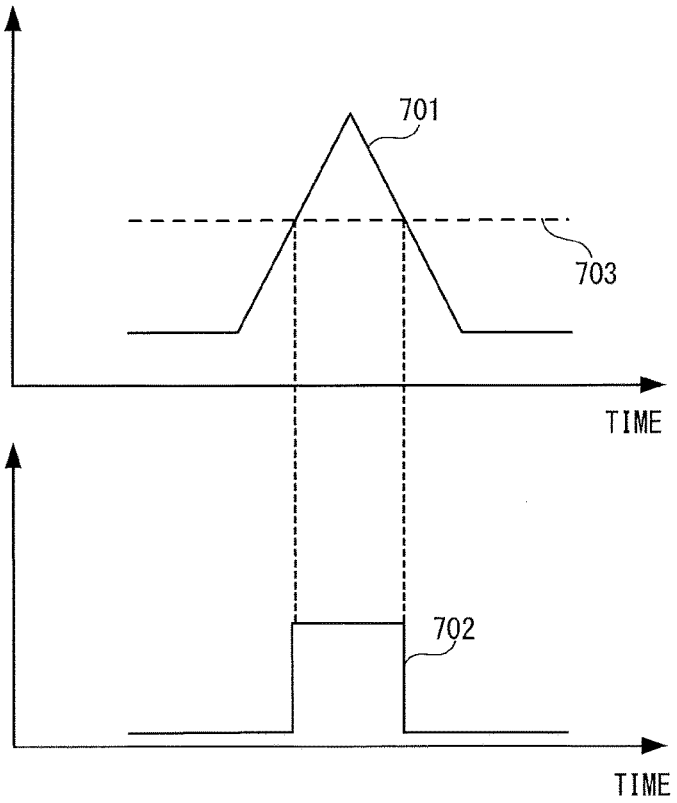
FIG. 6 is an explanatory diagram of an analog signal.

FIG. 6 is an explanatory diagram of an analog signal that expresses a measurement result of a position detection image. An analog signal 701 is binarized depending on a threshold 703 in the comparator 403 to be converted into a binarized signal 702. The surface of the intermediate transfer belt 104 is glossy. Therefore, an amount of light regularly reflected by the intermediate transfer belt 104 is larger than an amount of light regularly reflected by the chromatic-color position detection images. An amount of light emitted from the light emitting portion 120 of the density sensor 109 is fixed, and thus an amount of light diffusely reflected by the surface of the intermediate transfer belt 104 is smaller than an amount of light diffusely reflected by the chromatic-color toner images.

Therefore, the waveform of the analog signal 701 obtained by detecting the position detection images 301, 302, and 303, which are the chromatic-color toner images, has a shape that protrudes upward as illustrated in FIG. 6. In FIG. 6, the analog signal 701 is a triangle wave, but does not always become a triangle wave. The waveform of the analog signal 701 depends on widths of the position detection images 301, 302, and 303 in the direction of rotation (driving direction) of the intermediate transfer belt 104, and on a width of the detection area of the density sensor 109. Therefore, depending on a relationship of those widths, the analog signal 701 may have a waveform that is close to a trapezoid.

The binarized signal 702 is a signal obtained by binarizing the analog signal 701, which is output from the density sensor 109, by the comparator 403. The comparator 403 converts the analog signal 701 having an output level that is the threshold 703 or more into the high-level digital signal, and converts the analog signal 701 having an output level that is smaller than the threshold 703 into a low-level digital signal. The comparator 403 outputs the binarized signal 702 including the high-level digital signal and the low-level digital signal.

The black toner image absorbs light from the light emitting portion 120. In other words, an analog signal value corresponding to a detection result of the black toner pattern and an analog signal value corresponding to a detection result of the intermediate transfer belt 104 are not very different. Therefore, the black position detection image is the composite toner pattern 304. The density sensor 109 detects the composite toner pattern 304 based on a difference between the amounts of reflection light of the chromatic-color toner pattern 801 and the black toner patterns 802 and 803 of the composite toner pattern 304.

Figure 7A:
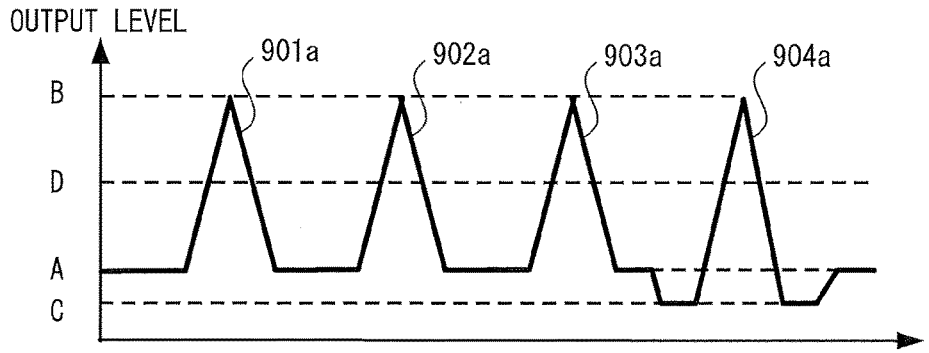
FIG. 7A and FIG. 7B are explanatory diagrams of measurement results of the position detection images.
Figure 7B:
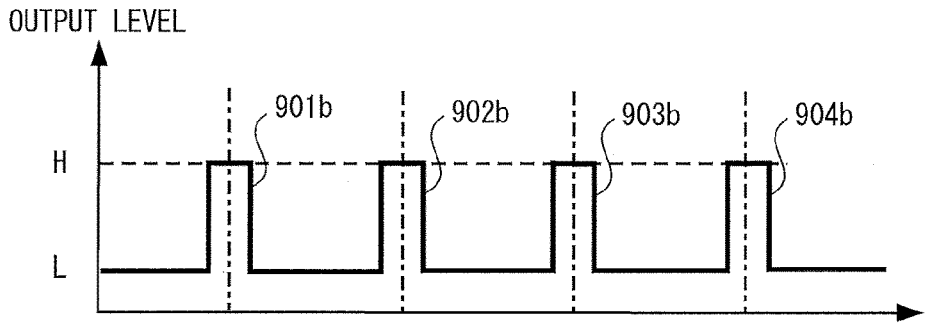

FIG. 7A and FIG. 7B are explanatory diagrams of the measurement results of the position detection images of FIG. 5. In FIG. 7A, waveforms of analog signals are illustrated. In FIG. 7B, the binarized signals obtained by binarizing the analog signals are illustrated.

The density sensor 109 receives the diffuse reflection light from the intermediate transfer belt 104, and outputs an analog signal having an output level A. The density sensor 109 receives the diffuse reflection light from the yellow, magenta, and cyan position detection images 301, 302, and 303, and outputs analog signals having an output level B. An analog signal 901*a* indicates a measurement result of the yellow position detection image 301. An analog signal 902*a* indicates a measurement result of the magenta position detection image 302. An analog signal 903*a* indicates a measurement result of the cyan position detection image 303. The output level A is lower than the output level B.

The density sensor 109 receives the diffuse reflection light from the composite toner pattern 304, and outputs an analog signal 904*a*. When detecting the composite toner pattern 304, the density sensor 109 first receives the diffuse reflection light from the intermediate transfer belt 104, and outputs an analog signal having the output level A. The density sensor 109 receives the diffuse reflection light from the black toner pattern 802 conveyed to the detection area, and outputs an analog signal having an output level C, which is lower than the output level A. The density sensor 109 receives the diffuse reflection light from the magenta toner pattern 801, which is conveyed to the detection area after the toner pattern 802, and outputs an analog signal having the output level B. The density sensor 109 receives the diffuse reflection light from the black toner pattern 803, which is conveyed to the detection area after the toner pattern 801, and outputs an analog signal having the output level C. When the composite toner pattern 304 is conveyed out of the detection area, the density sensor 109 receives the diffuse reflection light from the intermediate transfer belt 104, and outputs an analog signal having the output level A. The composite toner pattern 304 passes through the detection area by being conveyed by the intermediate transfer belt 104. Therefore, the output level of the analog signal corresponding to the detection result of the composite toner pattern 304 is changed while the composite toner pattern 304 passes through the detection area.

The position at which the black toner image is formed is indirectly detected with a waveform of the analog signal 904*a* generated based on the magenta toner pattern 801. Therefore, the composite toner pattern 304 is formed so that the black toner patterns 802 and 803 are formed to be separated from each other by a predetermined interval, and so that the magenta toner pattern 801 is exposed from therebetween.

The analog signals as in FIG. 7A are converted into binarized signals as in FIG. 7B by the comparator 403. The comparator 403 generates the binarized signals through comparison between a threshold D and the output levels of the analog signals. The threshold D is a value between the output level B and the output level A. The yellow analog signal 901*a* is converted into a binarized signal 901*b* by the comparator 403. The magenta analog signal 902*a* is converted into a binarized signal 902*b* by the comparator 403. The cyan analog signal 903*a* is converted into a binarized signal 903*b* by the comparator 403. The analog signal 904*a* of the composite toner pattern is converted into a binarized signal 904*b* by the comparator 403.

The CPU 401 detects the positions at which the toner images of the respective colors are formed based on differences between barycentric positions of the binarized signals generated by the comparator 403 and a barycentric position of the binarized signal obtained from the position detection image 302 of the reference color (in this embodiment, magenta). Differences between barycentric positions of the toner images of the respective colors and a barycentric position of the reference color under a state in which no color misregistration occurs are stored as reference values in the memory 402. The CPU 401 detects the color misregistration amount by comparing the reference values stored in the memory 402 and the actually measured differences between the barycentric positions. The CPU 401 performs color misregistration correction control based on the detected color misregistration amount. The CPU 401 performs the color misregistration correction by causing the image forming units 101 to control timings at which the exposure devices 103 emit the laser light before the image formation so that the color misregistration is eliminated, for example.

Figure 8:
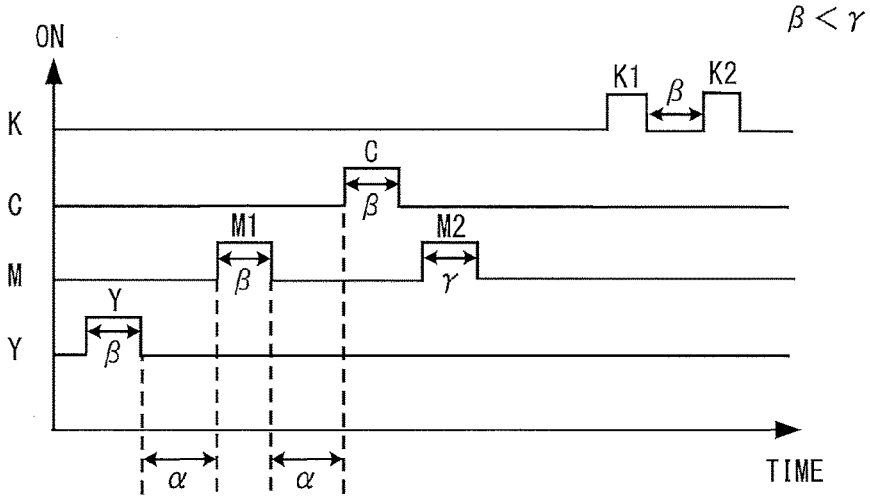
FIG. 8 is a timing chart for illustrating timings to send image data to respective image forming units.

FIG. 8 is a timing chart for illustrating timings at which the image data of the position detection images of the respective colors are sent to the respective image forming units 101. The position detection images 301, 302, and 303, and the composite toner pattern 304 are formed in the order corresponding to the arrangement of the image forming units 101Y, 101M, 101C, and 101K.

The CPU 401 sends the image data for forming the position detection images to the respective image forming units 101Y, 101M, 101C, and 101K at timings corresponding to the arrangement of the respective image forming units and a rotation speed of the intermediate transfer belt 104. The CPU 401 first sends image data Y for forming the yellow position detection image 301 to the image forming unit 101Y. The CPU 401 then sends image data M1 for forming the magenta position detection image 302 to the image forming unit 101M, and subsequently sends image data C for forming the cyan position detection image 303 to the image forming unit 101C. The CPU 401 sends the image data Y, M1, and C at predetermined time intervals a so that the position detection images 301, 302, and 303 are sequentially formed. The image data Y, M1, and C are set so that a time period β in which each image is formed is the same. Therefore, the position detection images 301, 302, and 303 have equal widths in the direction of rotation of the intermediate transfer belt 104.

The CPU 401 having sent the image data C for forming the cyan position detection image 303 performs control for forming the composite toner pattern 304. The CPU 401 first sends image data M2 for forming the magenta toner pattern 801 to the image forming unit 101M. A time period γ in which the image of the image data M2 is formed is longer than the time period β. After sending the image data M2, the CPU 401 sends image data K1 for forming the black toner pattern 802 to the image forming unit 101K. After the time period β has elapsed from sending the image data K1, the CPU 401 sends image data K2 for forming the black toner pattern 803 to the image forming unit 101K. In such composite toner pattern 304 formed with the image data M2, K1, and K2, the magenta toner pattern 801 is exposed for a width that is the same as widths of the position detection images 301, 302, and 303 in the direction in which those images are conveyed by the intermediate transfer belt 104.

Figure 9:
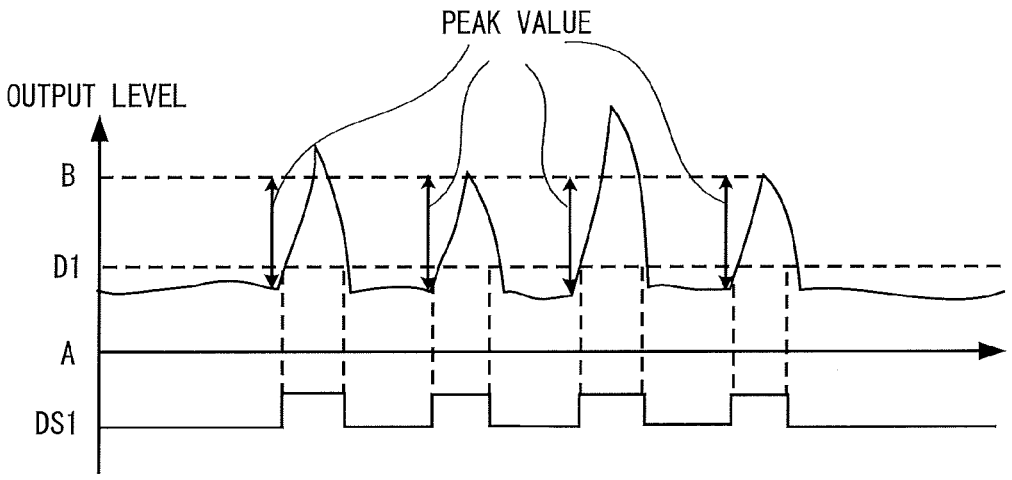
FIG. 9 is an explanatory diagram of measurement results of the position detection images.

FIG. 9 is an explanatory diagram of measurement results of the position detection images. In FIG. 9, unlike FIG. 7A and FIG. 7B, the analog signals have distorted triangle waveforms due to the change in shape of the surface of the intermediate transfer belt 104 on which the toner image 122 is formed, the part tolerance of the density sensor 109, the unevenness of the toner image 122, and other such reasons. In FIG. 9, the analog signals are distorted, and the analog signals of the respective colors have different wave heights (differences between measurement results of portions in which the toner images are formed and portions in which the toner images are not formed). The comparator 403 converts the analog signals into a binarized signal DS1 with a threshold D1.

When acquiring the binarized signal DS1, the CPU 401 counts timings of rising edges and falling edges thereof with the counter 405. Centers between the rising edges and the falling edges are the barycentric positions of the position detection images, and are used for the detection of the color misregistration.

Figure 10A:
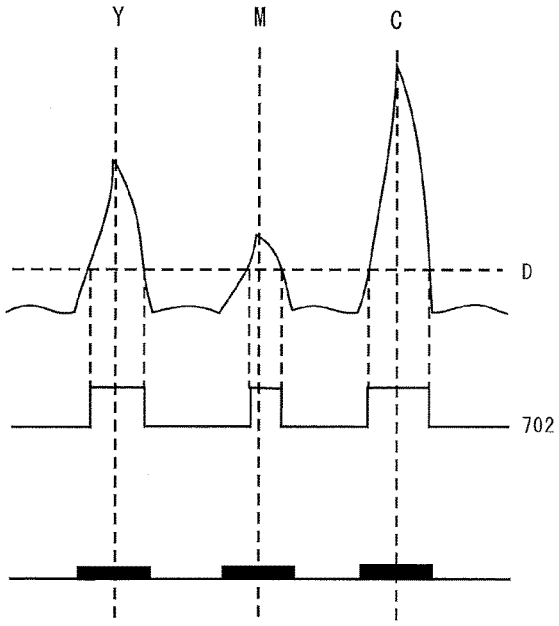
FIG. 10A, FIG. 10B, and FIG. 10C are explanatory diagrams of effects of wave heights of analog signals on a color misregistration amount.
Figure 10B:
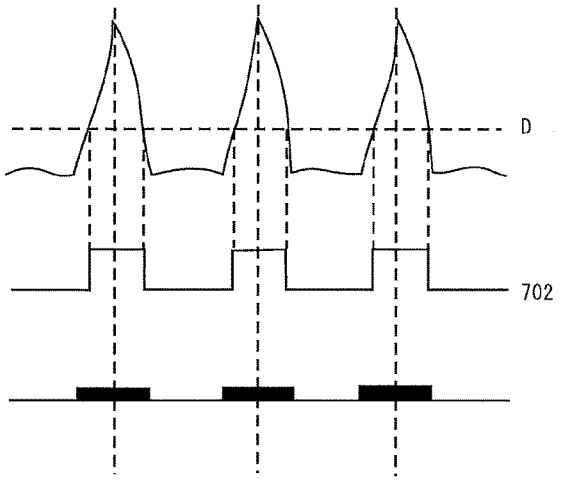
Figure 10C:
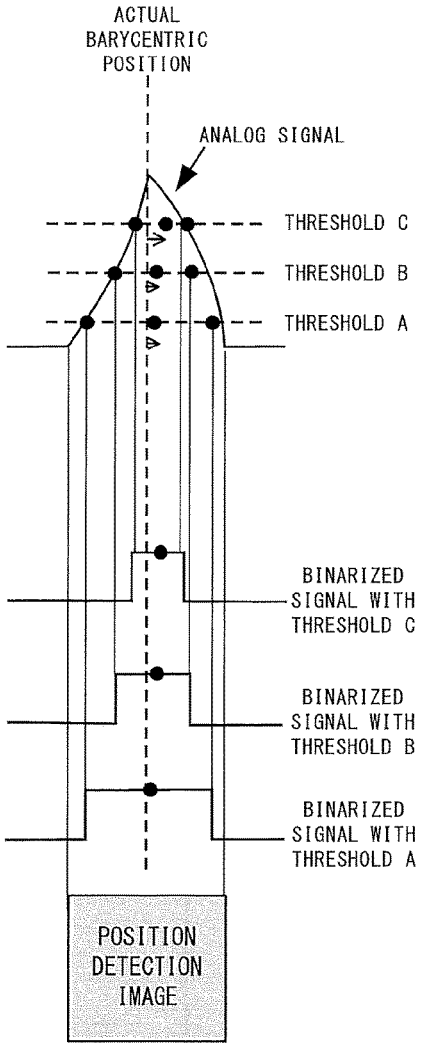

FIG. 10A to FIG. 10C are explanatory diagrams of effects of the wave heights of the analog signals on the color misregistration amount. In FIG. 10A, barycentric positions when the binarized signals have different wave heights are illustrated. In FIG. 10B, barycentric positions when the binarized signals have the same wave height are illustrated. In FIG. 10C, there are illustrated the effects of thresholds used by the comparator 403 in converting an analog signal into a binarized signal on the wave height. All the analog signals are distorted.

When the analog signals of the respective colors have the different peak values (FIG. 10A), and when the binarized signals are generated with the same threshold D, an error of the barycentric position of the binarized signal 702 is different for each analog signal. A case where the analog signal has a small wave height and a threshold for converting into the binarized signal is close to the peak value (threshold C of FIG. 10C) and a case where the analog signal has a large wave height and a threshold is close to a bottom value (threshold A of FIG. 10C) are different in barycentric positions of the binarized signals. Therefore, as illustrated in FIG. 10A, for the analog signals having the different peak values, the error of the barycentric position is different for each analog signal. In this case, it becomes difficult to calculate an accurate color misregistration amount.

When the analog signals of the respective colors have the same peak value (FIG. 10B), and when the signals are converted through binarization with the same threshold D, errors of the barycentric positions of the binarized signal 702 are similar among the analog signals. Therefore, detection errors of the position detection images of the respective colors are canceled at the time when the color misregistration amount is calculated, and the accurate color misregistration amount is calculated.

Therefore, in order to detect the color misregistration amount with a small error and high accuracy, the output levels of the analog signals need to be matched among the respective colors. The output levels of the analog signals are determined depending on laid-on levels of the toner images. When shifts in density occur among the toner images, differences occur among the peak values of the analog signals as in FIG. 10A. Therefore, there is a need to adjust densities of the toner images of the respective colors so as to match the output levels of the analog signals among the respective colors. In this embodiment, in order to detect the color misregistration amount with high accuracy, the image density correction is performed as described below to manage the image data of the position detection images, to thereby adjust the densities of the position detection images.

Image Density Correction

Figure 11:
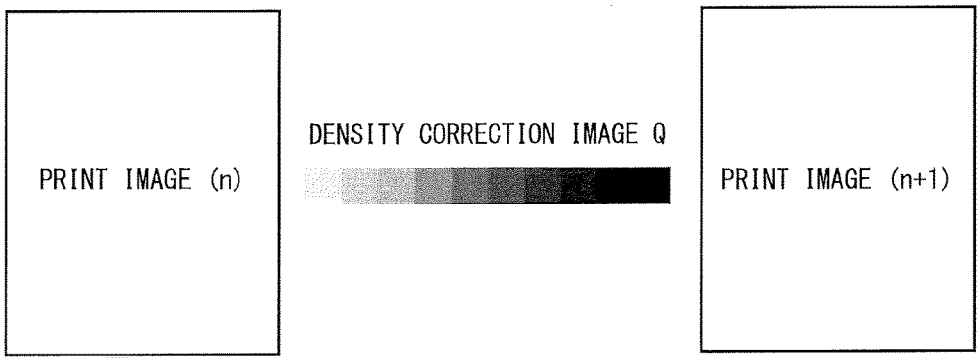
FIG. 11 is an explanatory diagram of a density correction image.

In the image density correction, a density correction image, which is a toner image for the image density correction, is formed. FIG. 11 is an explanatory diagram of the density correction image. A density correction image Q is formed for each color of patch images, which are formed in a plurality of densities (plurality of gradation levels) including the maximum density (Dmax portion), arranged side by side in the sub-scanning direction. Moreover, the density correction images Q of the respective colors are formed side by side in the direction of rotation of the intermediate transfer belt 104 so as to pass through the detection area of the density sensor 109*d*. The density correction images Q are formed between pages on which images are formed, that is, between print images.

Figure 12:
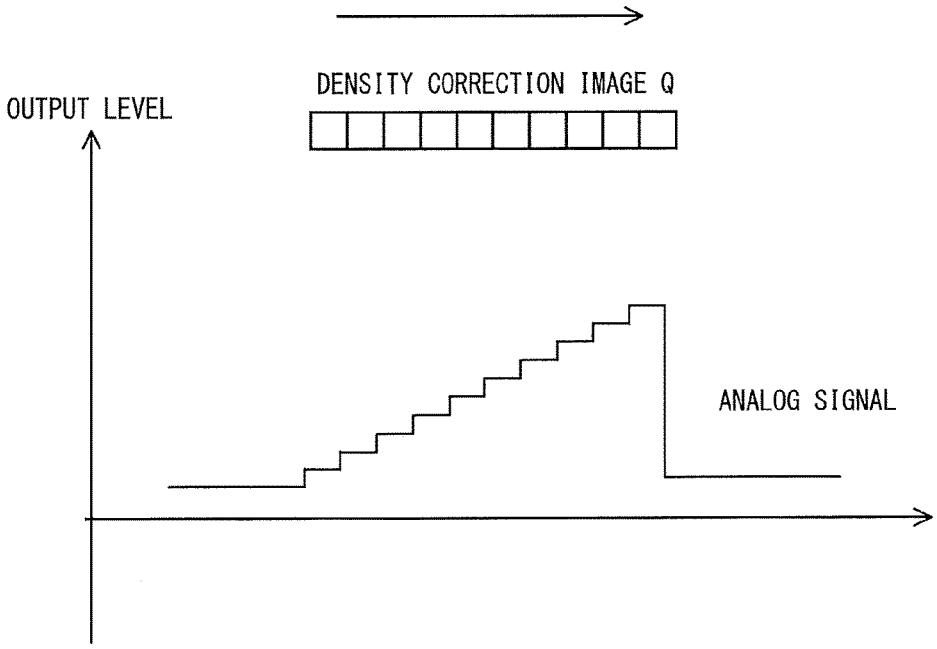
FIG. 12 is an exemplary diagram of a density digital signal.

The density sensor 109*d* irradiates the density correction image Q with light at a timing when the density correction image Q passes through the detection area to measure an amount of reflection light from the density correction image Q. The measurement result is output as an analog signal indicating densities. The density sensor 109*d* sends the analog signal to the A/D converter 404. The analog signal is converted into a density digital signal in the A/D converter 404 to be input to the CPU 401. FIG. 12 is an exemplary diagram of the density digital signal. The CPU 401 has a table for converting from the amount of reflection light indicated by the density digital signal to image densities. The CPU 401 refers to the table to determine the densities of the density correction image Q.

The image density correction is performed based on measurement results of the density correction images Q, which are formed between predetermined numbers of pages, for example, between the 100th page and the 101st page during consecutive image formation. During the image density correction, the CPU 401 instructs each of the image forming units 101 to form the density correction image Q. Each of the image forming units 101 forms the toner image of the density correction image Q on the intermediate transfer belt 104 in response to the instruction.

The CPU 401 performs, based on the measurement results of the density correction images Q from the density sensor 109*d*, the image density correction so that densities of the images formed by the image forming units 101Y, 101M, 101C, and 101K become a target density. The CPU 401 generates a laser drive pulse having a pulse width corresponding to a predetermined density based on image data of the density correction image Q, which is stored in the printer controller 406 in advance. The exposure device 103 irradiates the photosensitive drum 102 with the laser light for a time period corresponding to the laser drive pulse to form an electrostatic latent image on the photosensitive drum 102. The electrostatic latent image is developed to form the toner image of the density correction image Q corresponding to the predetermined density on the photosensitive drum 102. The toner image is transferred onto the intermediate transfer belt 104.

Figure 13:
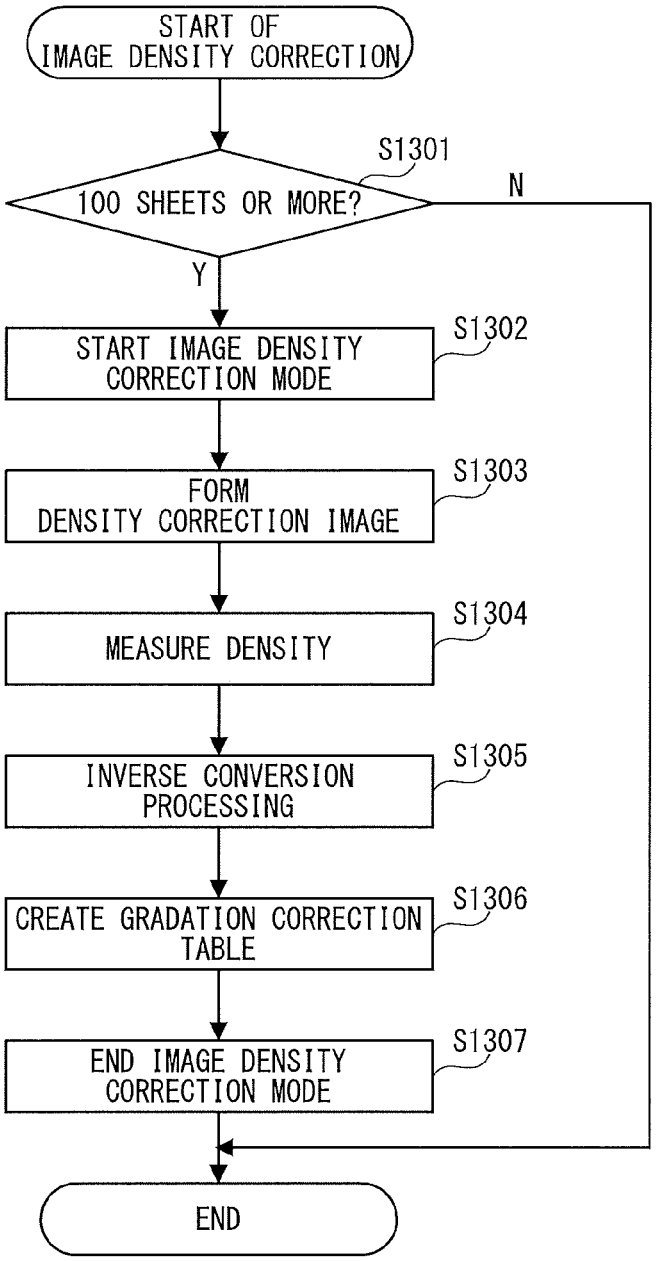
FIG. 13 is a flow chart for illustrating image density correction processing.

FIG. 13 is a flow chart for illustrating image density correction processing. The image density correction processing is performed for every color.

The CPU 401 performs the image density correction processing after forming images on a predetermined number of sheets. In this embodiment, in order to perform the image density correction processing for every 100 sheets, the CPU 401 determines whether or not images have been formed on cumulative 100 sheets (Step S1301). When the images have not been formed on 100 sheets (Step S1301: N), the CPU 401 ends the image density correction processing, and returns to a normal state. When the images have been formed on 100 or more sheets (Step S1301: Y), the CPU 401 starts operation in an image density correction mode (Step S1302).

When starting the operation in the image density correction mode, the CPU 401 controls operation of the image forming units 101 to form the density correction images Q, which are the toner images, on the intermediate transfer belt 104 (Step S1303). At this time, the CPU 401 determines, depending on environmental conditions (temperature and humidity) in the image forming apparatus 10, which are detected by the temperature sensor 130 and the humidity sensor 131, image forming conditions, such as an exposure amount of the laser light by the exposure device 103. A correspondence of the exposure amount of the laser light and the environmental conditions is stored in advance in the memory 402. The CPU 401 refers to the memory 402 to determine the exposure amount. The density sensor 109*d* measures a density of the density correction image Q formed on the intermediate transfer belt 104 (Step S1304). The density sensor 109*d* sends an analog signal, which is the measurement result, to the A/D converter 404.

Figure 14:
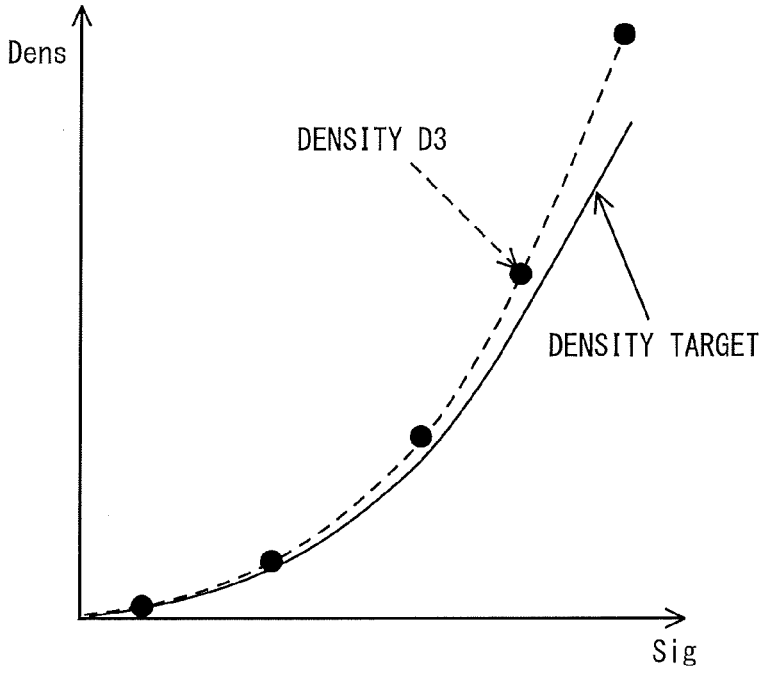
FIG. 14 is an explanatory diagram of a density plotted with respect to a density target.

The A/D converter 404 converts the analog signal into a density digital signal. The CPU 401 acquires the density digital signal from the A/D converter 404. The CPU 401 plots a density corresponding to the acquired density digital signal with respect to a predetermined density target. FIG. 14 is an explanatory diagram of the density plotted with respect to the density target. In FIG. 14, a density D3 is plotted. Densities corresponding to 10 gradation levels of the density correction image Q are plotted with respect to the density target. Details of the density target are described later.

The CPU 401 linearly interpolates the measured densities (broken line in FIG. 14) to grasp a density characteristic (gradation characteristic) based on a relationship of the measured densities and the density target. The CPU 401 performs inverse conversion processing on the density characteristic (gradation characteristic) with respect to the density target (Step S1305). By performing the conversion transform processing, the CPU 401 creates the gradation correction table, which is a look-up table (Step S1306). The CPU 401 stores the created gradation correction table in the memory 402, for example. When finishing the creation of the gradation correction table, the CPU 401 ends the image density correction mode (Step S1307), and returns to the normal state. An image density correction table is used in correcting the image data during the image formation.

Density Target

Figure 15:
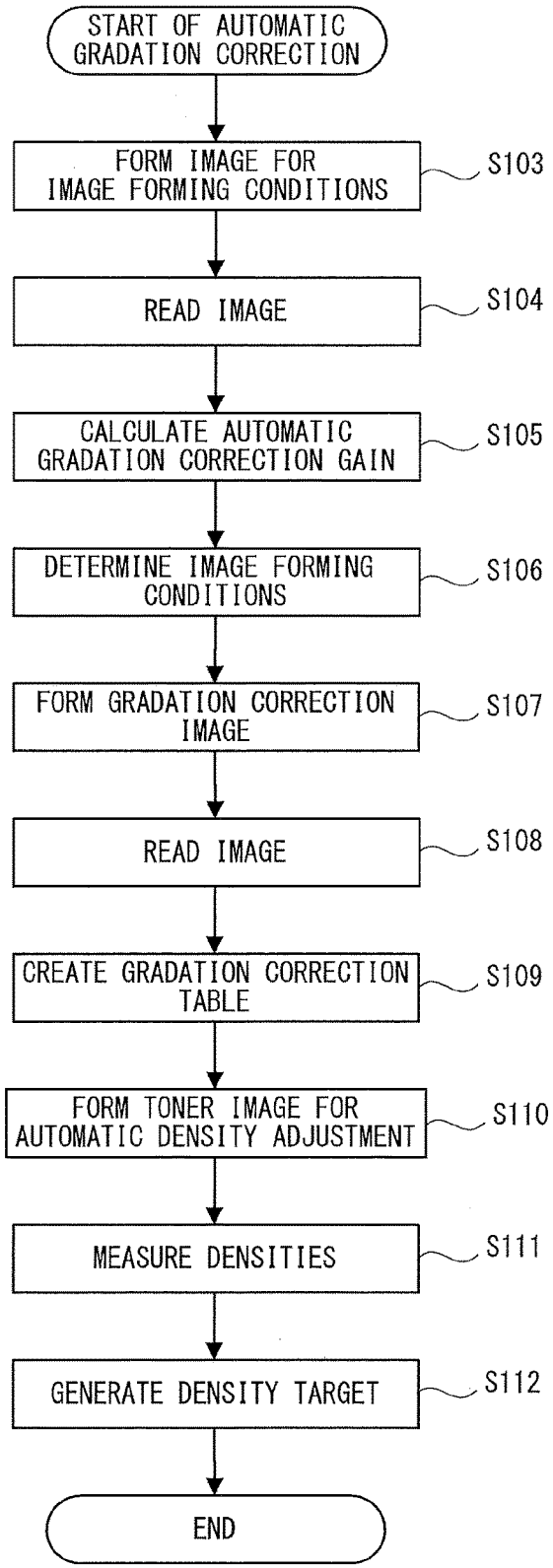
FIG. 15 is a flow chart for illustrating automatic gradation correction processing.

The density target is generated through automatic gradation correction, which is executed at the user's discretion or automatically, and is stored in the memory 402. In this embodiment, an example in which the density target is set through the automatic gradation correction is described. FIG. 15 is a flow chart for illustrating automatic gradation correction processing.

When starting the automatic gradation correction processing, the CPU 401 first forms a test image (image for the image forming conditions) of each color, which includes an image having 10 gradation levels including the maximum density, on the sheet with the image forming apparatus 10 (Step S103). In the processing of Step S103, the image for the image forming conditions corresponds to the test image. The user places the sheet having formed thereon the image for the image forming conditions on the original table 202 of the image reading apparatus 30. The image reading apparatus 30 reads the image for the image forming conditions from the sheet placed on the original table 202, and sends the read data to the CPU 401 (Step S104).

Figure 16:
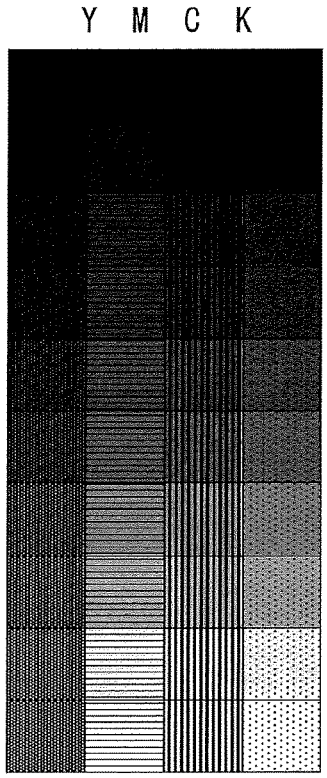
FIG. 16 is an exemplary diagram of an image for image forming conditions.

FIG. 16 is an exemplary diagram of the image for the image forming conditions. Based on the image of the maximum density (Dmax portion) of the image for the image forming conditions, the image forming conditions for a solid image density are determined. The image for the image forming conditions is formed by changing the exposure amount in the sub-scanning direction with respect to the image of the maximum density. In this embodiment, with respect to an exposure amount (LPW_Ref), which is a center immediately before the processing, the exposure amount is changed by ±5%, ±10%, ±15%, ±20%, and ±25% to form the image for the image forming conditions. The CPU 401 determines an exposure amount (LPW) with respect to the density target based on the exposure amount at the time of forming the image for the image forming conditions.

Figure 17:
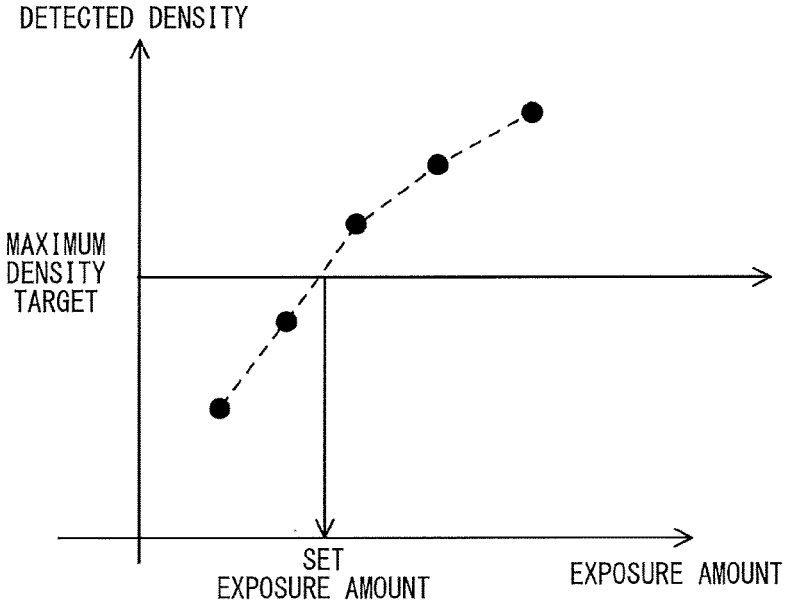
FIG. 17 is a graph for showing a relationship between an exposure amount and a density.

The CPU 401 detects densities of the image for the image forming conditions from a result of reading the image for the image forming conditions, which is acquired from the image reading apparatus 30, and determines the image forming conditions depending on the detected densities (Step S106). The image forming conditions include a charge potential of the photosensitive drum 102, a developing potential of the developing device, the exposure amount of the laser light by the exposure device 103, and the like. In this embodiment, the CPU 401 determines the exposure amount as the image forming conditions. FIG. 17 is a graph for showing a relationship between the exposure amount as the image forming conditions and the detected densities. The CPU 401 determines, based on such relationship, the image forming conditions (set exposure amount) from the densities of the image for the image forming conditions.

Figure 18:
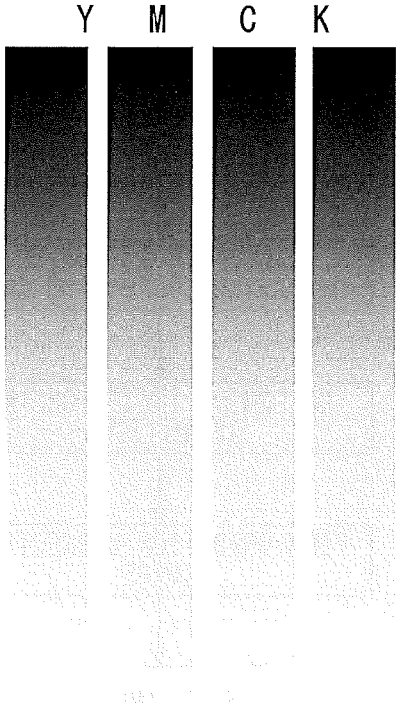
FIG. 18 is an exemplary diagram of a gradation correction image.

After having determined the image forming conditions, the CPU 401 subsequently performs gradation correction control. The CPU 401 first forms the test images (gradation correction images) of the respective colors on the sheet with the image forming apparatus 10 (Step S107). The user places the sheet having formed thereon the gradation correction image on the original table 202 of the image reading apparatus 30. The image reading apparatus 30 reads the gradation correction image from the sheet placed on the original table 202, and sends the read data to the CPU 401 (Step S108). FIG. 18 is an exemplary diagram of the gradation correction image. The gradation correction image includes an image of 64 gradation levels in the sub-scanning direction for each color.

The CPU 401 detects densities of the gradation correction image from the read result of the gradation correction image, which is acquired from the image reading apparatus 30, and acquires the density characteristic (gradation characteristic) over the entire density region depending on the detected densities. The CPU 401 creates, based on the acquired density characteristic (gradation characteristic) and a gradation target, which is set in advance, the gradation correction table, which is a correction table for the image data (Step S109). When the gradation correction table has already been created in the processing of Step S1306, the CPU 401 replaces the gradation correction table created in Step S1306 with the gradation correction table created in Step S109. Through the creation of the gradation correction table, the densities of the image formed on the sheet with respect to the gradation target are matched with one another over the entire density region.

The CPU 401 uses the image forming conditions and the gradation correction table, which are set as described above, to cause each of the image forming units 101 to form a toner image (measurement image) for automatic density adjustment for each color on the intermediate transfer belt 104 (Step S110). The toner image (measurement image) for the automatic density adjustment includes an image having 10 gradation levels for each color. The CPU 401 causes the density sensor 109*d* to measure densities of the toner image (measurement image) for the automatic density adjustment. The CPU 401 acquires the measurement result of the densities of the toner image (measurement image) for the automatic density adjustment from the density sensor 109*d* (Step S111). This measurement result is set as the density target for the image data on the intermediate transfer belt 104. In this embodiment, as the toner image for the automatic density adjustment, an image having 10 gradation levels like the density correction image Q of FIG. 11 is used. The CPU 401 stores, as the density target, the measurement result from the density sensor 109*d* in the memory 402 (Step S112). In this manner, the density target is set. In the above description, the CPU 401 stores, as the density target, the density of the measurement image in the memory 402, but may be configured to store, as a target level, an output level of the density sensor 109*d* corresponding to the detection result of the measurement image in the memory 402, for example.

Color Misregistration Correction Processing

As described above, due to the part tolerance, a mounting position tolerance, unevenness of the surface of the intermediate transfer belt 104 caused by a change with time, and the like, the measurement results (analog signals) of the position detection images for the color misregistration correction are distorted. Even when the measurement results are distorted, there is a need to accurately grasp the color misregistration amount to perform accurate color misregistration correction. In this embodiment, in order that the relationship among the barycentric positions obtained from the measurement results of the respective colors is not shifted even when the measurement results are distorted, the image forming apparatus 10 forms the position detection images so that the peak values of the measurement results are the same for each color.

Figure 19:
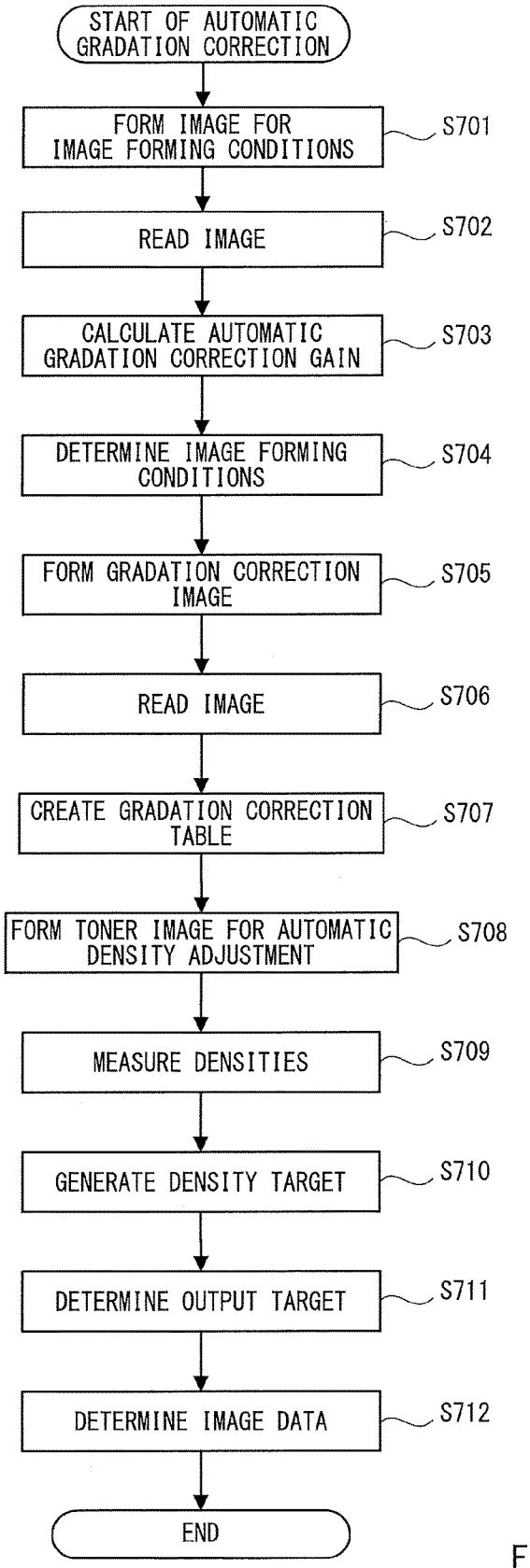
FIG. 19 is a flow chart for illustrating the automatic gradation correction processing.

The image data is corrected so as to equalize the peak values of the measurement results of the toner images of the respective colors on the intermediate transfer belt 104, which are formed depending on the result of the automatic gradation correction. In this embodiment, densities of the position detection images at the time of the color misregistration correction are set through the automatic gradation correction. FIG. 19 is a flow chart for illustrating the automatic gradation correction processing. Processing of Steps S701 to S710 of FIG. 19 is processing similar to that of Steps S103 to S112 of FIG. 15, and hence a description thereof is omitted. The image forming conditions determined in Step S704 are the charge potential, the developing potential, and the exposure amount.

Figure 20:
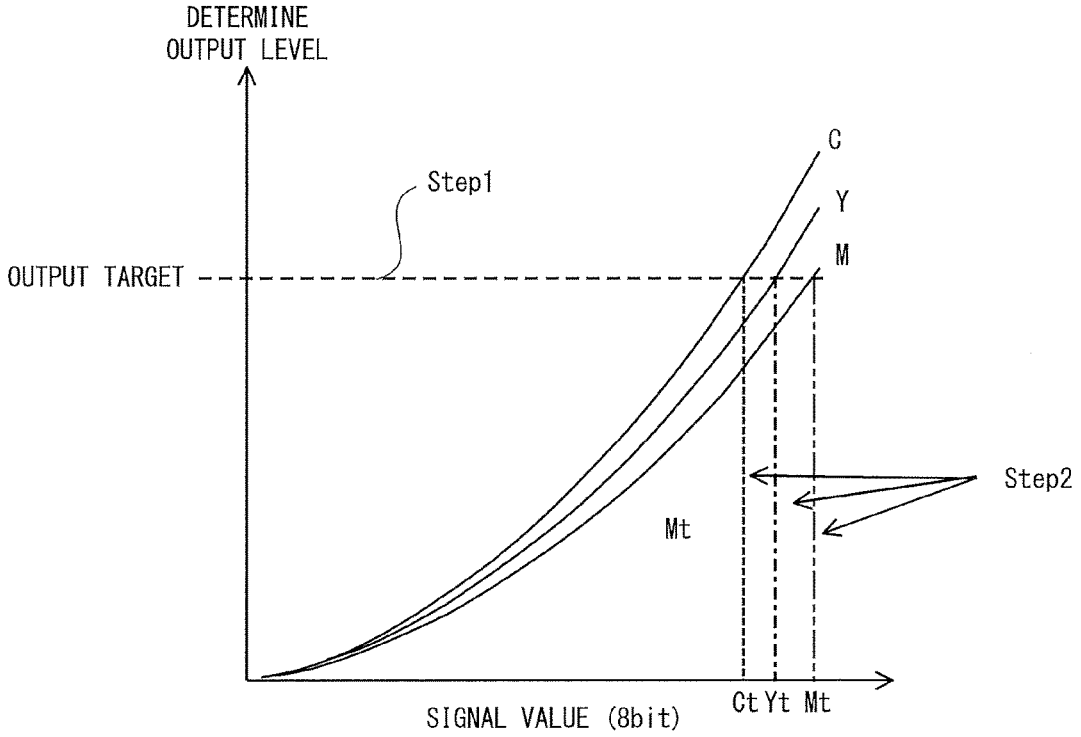
FIG. 20 is a comparison diagram of the density target.

After generating the density target, the CPU 401 compares amounts of reflection light of the position detection images of the respective colors, and determines the image data (measurement image data) of the position detection images of the respective colors so as to equalize the amounts of reflection light. To that end, the CPU 401 compares the measurement results of the density correction images Q (output levels corresponding to detection results of the position detection images of the respective colors) for each color. The density correction images Q correspond to first measurement images. FIG. 20 is a comparison diagram of the output levels corresponding to the detection results of the position detection images of the respective colors. The CPU 401 compares the output levels of the position detection images of the respective colors, determines a color having the lowest output level from among the output levels of the position detection images of the respective colors, and determines the output level of the position detection image of the determined color as a target value of the output level (Step S711). In the processing of Step S711, the CPU 401 functions as a selecting unit configured to select a color of interest. The CPU 401 corresponds to a selector. The CPU 401 determines a signal value of the image data of the position detection images of the respective colors to be the determined target value of the output level (Step S712). In the processing of Step S712, the CPU 401 functions as a determination unit configured to determine the measurement image data so that the output levels of the position detection images become the target value. In the example of FIG. 20, a signal value Yt is determined for the yellow image data, a signal value Mt is determined for the magenta image data, and a signal value Ct is determined for the cyan image data. In this example, the color of interest is magenta. The magenta signal value Mt is first measurement image data for forming the position detection image of the color of interest. Then, the yellow signal value Yt is second measurement image data for forming the position detection image of another color, for example.

Figure 21A:
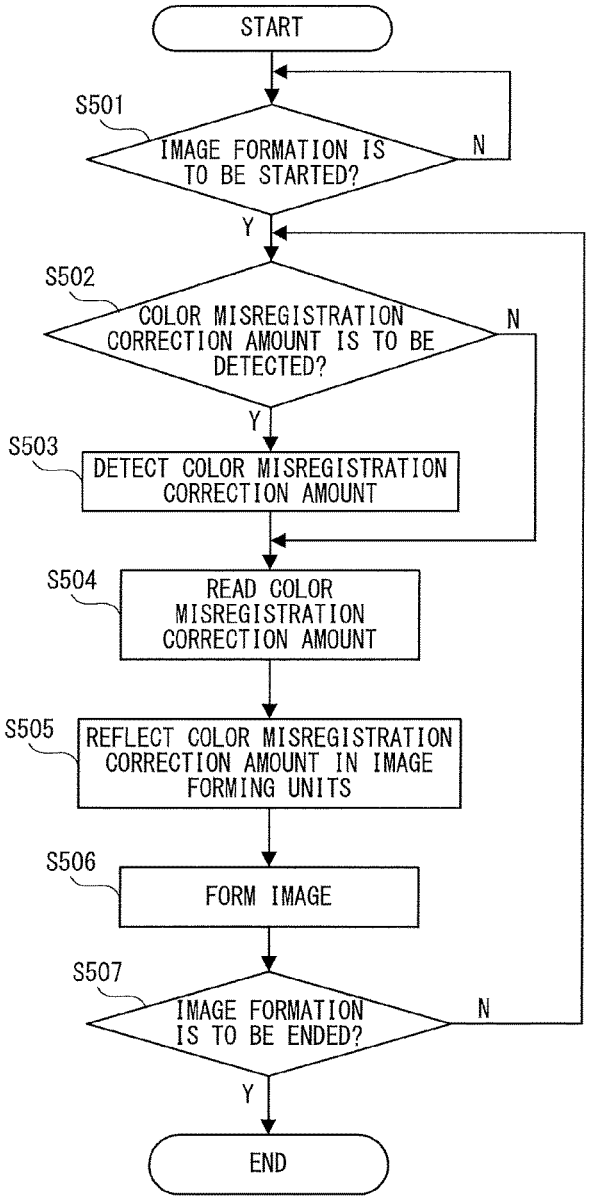
FIG. 21A and FIG. 21B are flow charts for illustrating image forming processing including color misregistration correction processing.
Figure 21B:
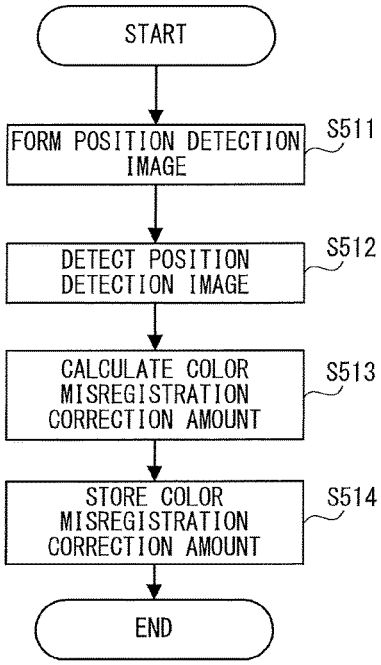

The CPU 401 performs color misregistration correction processing based on the thus-determined signal values of the image data. FIG. 21A and FIG. 21B are flow charts for illustrating the image forming processing including the color misregistration correction processing. In FIG. 21A, the image forming processing is illustrated. In FIG. 21B, the color misregistration correction processing is illustrated.

The CPU 401 starts the image forming processing when the image data is input thereto from the image reading apparatus 30 or the external apparatus (Step S501: Y). The CPU 401 determines whether or not there is a need to detect a color misregistration correction amount (Step S502). The CPU 401 determines whether or not there is a need to detect the color misregistration correction amount depending on whether or not an execution condition is satisfied. The CPU 401 determines that the execution condition is satisfied when the current time is immediately after the image forming apparatus 10 has been powered on, for example. Further, the CPU 401 determines that the execution condition is satisfied when the cumulative number of sheets on which images have been formed has reached a predetermined number of sheets after the color misregistration correction amount has been detected last time. Further, the CPU 401 determines that the execution condition is satisfied when differences between the environmental conditions at the time when the color misregistration correction amount has been detected last time and the current environmental conditions are larger than a predetermined value. The environmental conditions include an absolute water content and a temperature, for example.

When there is a need to detect the color misregistration correction amount (Step S502: Y), the CPU 401 detects the color misregistration correction amount (Step S503). The detection of the color misregistration correction amount is described later. After detecting the color misregistration correction amount, or when there is no need to detect the color misregistration correction amount (Step S502: N), the CPU 401 reads the color misregistration correction amount that has been detected in Step S503 or the color misregistration correction amount that has been detected in advance from the memory 402 (Step S504). The CPU 401 corrects a writing start position of an image based on the color misregistration correction amount read from the memory 402, and causes the image forming units 101 to form the image (Steps S505 and S506). The CPU 401 determines the end of the image forming processing depending on whether or not there is image data for image formation, for example (Step S507). When the image formation is not to be ended (Step S507: N), the CPU 401 repeats processing of Step S502 and the subsequent steps. When the image formation is to be ended (Step S507: Y), the CPU 401 ends the image forming processing.

Processing of detecting the color misregistration correction amount is described.

The CPU 401 forms the position detection images of the respective colors on the intermediate transfer belt 104 with the respective image forming units 101 (Step S511). At this time, the CPU 401 forms the position detection images of the respective colors based on the signal value determined in the processing of Step S712 so as to equalize the densities of the position detection images of the respective colors. The CPU 401 causes the density sensors 109 to detect the position detection images of the respective colors, and acquires the detection results of the position detection images of the respective colors (Step S512). The CPU 401 calculates the color misregistration correction amount based on the detection results from the density sensors 109, and stores the calculated color misregistration correction amount in the memory 402 (Steps S513 and S514). In this manner, the color misregistration correction amount is detected.

The above-mentioned image forming apparatus 10 according to this embodiment corrects the image data so that the peak values of the measurement results of the position detection images of the respective colors become the same when detecting the color misregistration correction amount. In the image forming apparatus 10, the measurement results have the equivalent peak values, and hence, even when the measurement results of the respective colors are equally distorted, the accurate color misregistration correction amount can be acquired. Therefore, the image forming apparatus 10 is capable of the accurate color misregistration correction. As described above, the image forming apparatus 10 corrects the positions at which the images are formed based on the position detection images of the respective colors, which are formed to correspond to the density target, with the result that, even when the density characteristic is changed, the color misregistration amount can be detected with high accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-138233, filed Jul. 13, 2016, which is hereby incorporated by reference herein in its entirety.

What is claimed is:

1. An image forming apparatus configured to form an image on a sheet, comprising:

a plurality of image forming units configured to form images of different colors based on image data;

an intermediate transfer member;

a measurement unit configured to measure a measurement image that is transferred onto the intermediate transfer member;

a selecting unit configured to control the plurality of image forming units to form first measurement images of different colors, control the measurement unit to measure the first measurement images on the intermediate transfer member, and select a color of interest based on measurement results of the first measurement images;

a determination unit configured to determine measurement image data based on (i) a measurement result of a first measurement image of the color of interest selected by the selecting unit and (ii) a measurement result of a first measurement image of another color; and a controller configured to control the plurality of image forming units to form second measurement images of different colors based on the measurement image data, control the measurement unit to detect a color misregistration amount for relative positions of a second measurement image of a reference color of the second measurement images and a second measurement image of another color of the second measurement images, and correct a write timing of each of the plurality of image forming units based on the color misregistration amount.

2. The image forming apparatus according to claim 1, wherein the determination unit is configured to determine first measurement image data for forming the second measurement image of the color of interest based on the measurement result of the first measurement image of the color of interest selected by the selecting unit, and wherein the determination unit is configured to determine second measurement image data for forming the second measurement image of the other color based on the measurement result of the first measurement image of the color of interest corresponding to the first measurement image data, and on the measurement result of the first measurement image of the other color.

3. The image forming apparatus according to claim 1, wherein the measurement unit comprises a sensor configured to receive reflection light from the measurement image to output an output value corresponding to an amount of received light, and wherein the selecting unit is configured to select the color of interest based on output values corresponding to the first measurement images output from the sensor.

4. The image forming apparatus according to claim 3, wherein the selecting unit is configured to determine, based on the output values corresponding to the first measurement images output from the sensor, a color for which the amount of received light is smallest as the color of interest.

5. The image forming apparatus according to claim 3, wherein the determination unit is configured to determine the measurement image data so that an output value corresponding to the second measurement image of the color of interest to be output from the sensor, and an output value corresponding to the second measurement image of the other color to be output from the sensor become the same.

6. The image forming apparatus according to claim 3, wherein the controller is configured to compare output values corresponding to the second measurement images output from the sensor and a threshold to detect the color misregistration amount based on a result of the comparison.

7. The image forming apparatus according to claim 1, wherein the measurement unit comprises a first sensor configured to output an output value corresponding to an amount of received reflection light from the first measurement images, and a second sensor configured to output an output value corresponding to an amount of received reflection light from the second measurement images.

8. The image forming apparatus according to claim 1, wherein the controller is further configured to control the plurality of image forming units to form a test image on the sheet, acquire read data on the test image on the sheet, which is output from a reading device, and generate image forming conditions for the plurality of image forming units based on the read data, and wherein the controller is configured to control, after generating the image forming conditions, the plurality of image forming units to form the first measurement images on the intermediate transfer member.

9. An image forming apparatus configured to form an image on a sheet, comprising:

a plurality of image forming units configured to form images, each having a different color;

an intermediate transfer member;

a sensor configured to measure a measurement image formed on the intermediate transfer member;

a controller configured to:

control the plurality of image forming units to form first measurement images, each having a different color;

control the sensor to measure the first measurement images;

select a color of interest based on a measurement result of the first measurement images;

generate measurement image data based on (i) a measuring result of a first measurement image having the color of interest and (ii) a measuring result of a first measurement image having another color different from the color of interest;

control, based on the measurement image data, the plurality of image forming units to form second measurement images, each having a different color, the second measurement images being used for detecting color misregistration;

control the sensor to measure the second measurement images; and control the detected color misregistration.

10. The image forming apparatus according to claim 9, wherein, in a case where the detected color misregistration is controlled, the controller adjusts relative positions between an image of a reference color to be formed by the plurality of image forming units and an image of another color to be formed by the plurality of image forming unit.

11. The image forming apparatus according to claim 9, wherein the sensor receives reflection light from the measurement image to output an output value corresponding to an amount of received light, and wherein the controller generates the measurement image data so that an output value corresponding to a second measurement image of the color of interest and an output value corresponding to a second measurement image of the other color become the same.

12. The image forming apparatus according to claim 9, wherein the sensor receives reflection light from the measurement image to output an output value corresponding to an amount of received light, and wherein the color of interest is selected as a color for which the amount of received light is smallest.

13. The image forming apparatus according to claim 9, wherein the controller controls the plurality of image forming units to form a test image on the sheet, acquire read data related to the test image on the sheet, the read data outputted from a reading device, and generate image forming conditions for the plurality of image forming units based on the read data, and wherein the controller controls, after generating the image forming conditions, the plurality of image forming units to form the first measurement images on the intermediate transfer member.

14. The image forming apparatus according to claim 9, wherein the sensor measures diffuse reflection light from the measurement image.

* * * * *